US007287347B2

(12) United States Patent
Hasan

(10) Patent No.: US 7,287,347 B2
(45) Date of Patent: Oct. 30, 2007

(54) HAZARDOUS-LOCATION-RATED EXIT SIGN

(75) Inventor: Syed Q. Hasan, Sugar Land, TX (US)

(73) Assignee: Rig-A-Lite Partnership Ltd., Houston, TX (US)

( * ) Notice: Subject to any disclaimer, the term of this patent is extended or adjusted under 35 U.S.C. 154(b) by 348 days.

(21) Appl. No.: 11/103,389

(22) Filed: Apr. 11, 2005

(65) Prior Publication Data

US 2006/0225328 A1 Oct. 12, 2006

(51) Int. Cl.
*G09F 13/00* (2006.01)

(52) U.S. Cl. ..... 40/553; 40/570; 40/541; 40/546

(58) Field of Classification Search ..... 40/541, 40/546, 553, 570; 169/19, 26, 7

See application file for complete search history.

(56) References Cited

OTHER PUBLICATIONS

Cooper Industries Catalog, p. 894 (2002).
Chloride Systems Catalog, p. C1144 (May 2001).
Grainger Catalog No. 395, pp. 757-759 (2004).

*Primary Examiner*—Lesley D. Morris
*Assistant Examiner*—Shin Kim
(74) *Attorney, Agent, or Firm*—Gary L. Bush, Esq.; Andrews Kurth LLP

(57) ABSTRACT

An exit sign for use in hazardous atmospheres including an explosion-proof housing and a sign panel with indicia thereon. The housing prevents the ignition of gas or vapor surrounding the enclosure due to sparks, flashes or an explosion of the gas or vapor within the enclosure by providing an ample heat sink surface along any flame path to cool gases escaping from the housing. The sign panel preferably includes one or more transparent sheets which are edge lit from a light source contained in the explosion-proof housing that shines through a window in the housing into the top edge of the sign panel to illuminate the face(s) and the indicia thereon. The light source utilizes a number of long life light emitting diodes. The exit sign preferably includes a sealed maintenance-fee rechargeable battery for powering the light source when externally supplied power to the exit sign is absent.

8 Claims, 2 Drawing Sheets

HAZARDOUS-LOCATION-RATED EXIT SIGN

BACKGROUND OF THE INVENTION

1. Field of the Invention

This invention relates generally to hazardous-location-rated fixtures and specifically to illuminated exit signs.

2. Description of the Prior Art

Fixtures for use within hazardous locations are well known. In the 1920s, the National Electric Code addressed requirements for fixtures to be located in rooms or compartments in which highly flammable gases, liquids, mixtures or other substances were manufactured, used or stored. In 1931, the NEC first defined hazardous location classifications Class I for gases and vapors, Class II for dusts, and Class III/Class IV for fibers. Four years later, the NEC subdivided Class I locations into groups based on explosive pressure and flame transmission capacity. Group A includes acetylene. Group B includes hydrogen. Group C includes ethyl ether, and Group D includes gasoline, petroleum, alcohol, acetone, solvent vapors, and gases and vapors of equivalent hazard. Likewise, in 1937, the NEC defined groups for Class II with Group E including metal dusts, Group F including coal and other carbonaceous dusts, and Group G including woods, plastic, et cetera. In 1947, the NEC combined flammable fiber Classes III and IV, and it introduced the concept of divisions, where Division 1 indicates a location where ignitable concentrations (of gases vapors or liquids for Class I and of combustible dusts for Class II) can exist all of the time or some of the time under normal operating conditions and where Division 2 indicates a location where ignitable concentrations (of gases vapors or liquids for Class I and of combustible dusts for Class II) are not likely to exist under normal operating conditions. For each class, group and division, performance and construction standards for fixtures have been established to ensure safety within the hazardous area.

Today, a worldwide industry exists for setting performance standards for devices which operate within hazardous locations and for certifying those devices which meet those standards. For example, Underwriters Laboratories (UL), National Fire Protection Association (NFPA), American National Standards Institute (ANSI), National Electrical Manufacturers Association (NEMA), Canadian Standards Association (CSA), International Electrotechnical Commission (IEC), and European Committee for Electrotechnical Standardization (CENELEC) all publish standards for equipment or fixtures to be located in various hazardous locations. In 1997, in response to recent attempts at global harmonization of the various international standards, the NEC introduced the international zone classification system for Class I as an alternative to Division 1 and Division 2 classifications, which are used only in the United States and Canada. Zone 0 indicates locations where ignitable concentrations of flammable gases, vapors, or liquids are present continuously or for long periods of time under normal operating conditions. Zone 1 indicates locations where ignitable concentrations of flammable gases, vapors or liquids are likely to exist under normal operating conditions, and Zone 2 indicates locations where ignitable concentrations of flammable gases, vapors or liquids are not likely to exist under normal operating conditions. The international zone classification system has its own group ratings to indicate the potential explosive pressure and flame transmission characteristics of the hazardous area.

Although somewhat obfuscatory, the various class/division or class/zone hazardous area classifications form a framework which can be used to summarize the accepted protection methods approved for use. For example, for areas where ignitable concentrations of flammable gases, vapors or liquids can exist all of the time or some of the time under normal operating conditions (Class I Division 1, U.S. and Canada only), accepted protection methods for fixtures include explosion-proof construction, Type X or Y purging/pressurizing of the fixture, or using two-fault intrinsically safe circuitry. Where ignitable concentrations of flammable gases, vapors or liquids are not likely to exist under normal operating conditions (Class I Division 2, U.S. and Canada only), the accepted protection methods can be relaxed to include less rigorous standards, including nonincendive or non-sparking device construction, Type Z purging/pressurizing, and hermetically sealed construction.

The Class I international zone classification protection methods are similar, but some differences exist. For Class I Zone 0 (where ignitable concentrations of flammable gases, vapors, or liquids are present continuously or for long periods of time under normal operating conditions), only two-fault intrinsically safe circuitry is authorized; neither purging/pressurizing nor explosion-proof construction is deemed sufficient. Class I Zone 1 (where ignitable concentrations of flammable gases, vapors, or liquids are likely to exist under normal operating conditions) protection methods include encapsulation, flameproof construction, one-fault intrinsically safe circuitry, oil immersion, powder filling, and purging/pressurizing. Class I Zone 2 (where ignitable concentrations of flammable gases, vapors, or liquids are not likely to exist under normal operating conditions) protection methods include nonincendive or non-sparking construction, restricted breathing, hermetically sealed construction, energy limited circuitry, and simplified pressurization techniques.

Class II categories have similar protection methods. For Class II Division 1 areas (where ignitable concentrations of combustible dusts can exist all of the time or some of the time under normal operating conditions), protection methods include dust ignition-proof construction, intrinsically safe circuitry, and pressurization. Class II Division 2 (where ignitable concentrations of combustible dusts are not likely to exist under normal operating conditions) protection methods include dust-tight construction and nonincendive or non-sparking construction.

Generally, the more stringent protection methods authorized for higher (more hazardous) area classifications can be used in areas characterized by lower (less hazardous) classifications. For example, in addition to the nonincendive or non-sparking construction, restricted breathing, hermetically sealed construction, energy limited circuitry, or simplified pressurization techniques authorized for Class I Zone 2 areas mentioned above, any protection method authorized for Class I Zone 0, Class I Zone 1, or Class I Division 1 is suitable for use in Class I Zone 2 areas.

Explosion-proof exit signs which are suitable for use in Class I Division 1 Groups C and D, Class 1 Zone 0 Groups C and D, Class II Division 1 Groups E, F, and G, and Class III areas, among others, are known in the art. They typically include two incandescent lamps housed in a casing designed to withstand the pressure of explosions generated by an internal arc without propagating the explosion into the surrounding hazardous atmosphere. Inevitably, the incandescent lamps are subject to burn out, requiring maintenance and upkeep. A relamping tool is generally required to replace the light bulbs, and should the maintenance person fail to properly seal the exit sign after lamp replacement, explosion-proof integrity may be compromised.

Further, the explosion-proof exit signs known in the art do not have an integral battery back-up or other source of redundant power to keep the signs illuminated during power failures. Thus, it is generally required to wire the exit signs on a dedicated circuit which is equipped with an external redundant power source such as an emergency generator. The separate circuit(s) required for exit signs results in increased facility construction costs.

It is advantageous to have an explosion-proof exit sign which does not require periodic lamp replacement and which contains an integral battery back-up.

3. Identification of Objects of the Invention

An object of the invention is to provide an exit sign suitable for use in areas with a hazardous or potentially hazardous atmosphere which uses a long-life low-powered non-incandescent light source for maximum reliability.

Another object of the invention is to provide an exit sign suitable for use in areas with a hazardous or potentially hazardous atmosphere which eliminates the requirement for external redundant power by including an internal rechargeable battery backup.

Another object of the invention is to provide a method for aiding emergency egress from an area with a hazardous or potentially hazardous atmosphere by providing a reliable exit sign.

SUMMARY OF THE INVENTION

The objects identified above, as well as other features of one or more embodiments of the invention are incorporated in a method and apparatus for an exit sign which is suitable for use in locations deemed hazardous due to the presence or potential presence of flammable vapors or gases or combustible dusts.

In a preferred embodiment, the exit sign includes an explosion-proof housing and a sign panel with one or more faces. Each face includes one or more emergency indicia. The sign panel preferably includes one or more transparent or translucent sheets which are edge lit from a light source contained in the explosion-proof housing. For double-faced exit signs, the sign panel preferably includes an opaque or mirrored separator sandwiched between two clear edge-lit thermoplastic sheets to prevent a user from viewing the indicia of the obverse face through the sign panel.

In the preferred embodiment, the explosion-proof housing includes a top shell and a bottom plate. The bottom plate has a window to allow light from the light source, located within the top shell, to pass through it into the top edge of the sign panel for illuminating the indicia. The housing is designed to be capable of withstanding an explosion of a specified gas or vapor that is expected to occur within the enclosure. Additionally, the housing is capable of preventing the ignition of gas or vapor surrounding the enclosure due to sparks, flashes or the explosion of the gas or vapor within the enclosure by providing an ample heat sink surface along any flame path to cool gases escaping from the housing. Further, the housing is capable of operating at an external temperature that will not ignite the surrounding gas or vapor In the preferred embodiment, the light source includes a number of long life light emitting diodes mounted to align with the window and the top edge of the sign panel. The exit sign preferably includes a sealed maintenance-fee rechargeable battery for powering the light source when externally supplied power to the exit sign is absent. A charging circuit is preferably provided to maintain the battery at an optimal charge and to recharge the battery after a discharge, and a manually operated test switch is included in the exit sign housing which allows a user to check the battery operation by executing a diagnostic testing sequence. A health indicator, mounted in the housing, displays the exit sign status.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
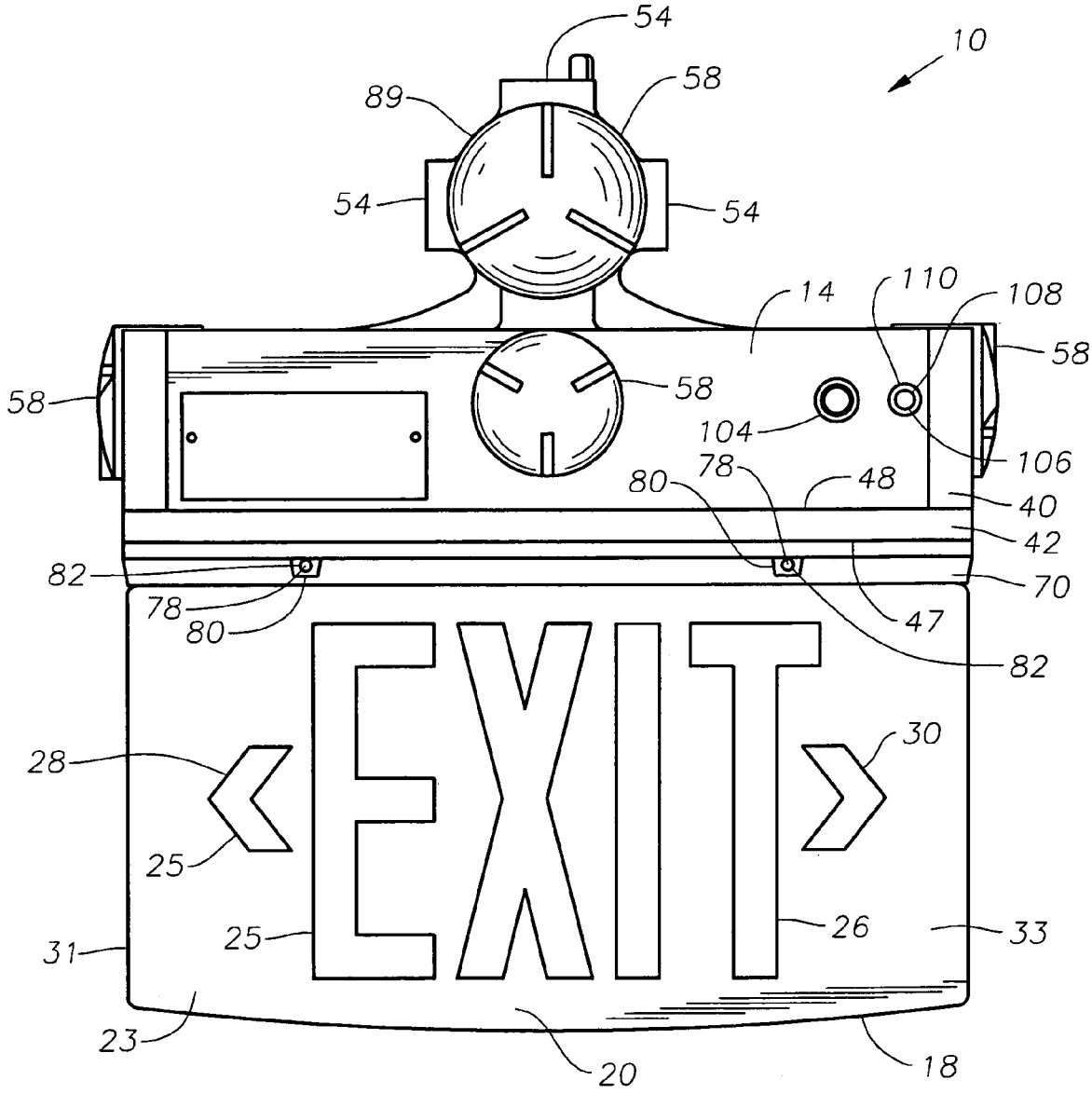
FIG. 1 is a front view of an exit sign according to one embodiment of the invention showing an LED edge-illuminated face with emergency indicia integrated with an explosion-proof housing.
Figure 2:
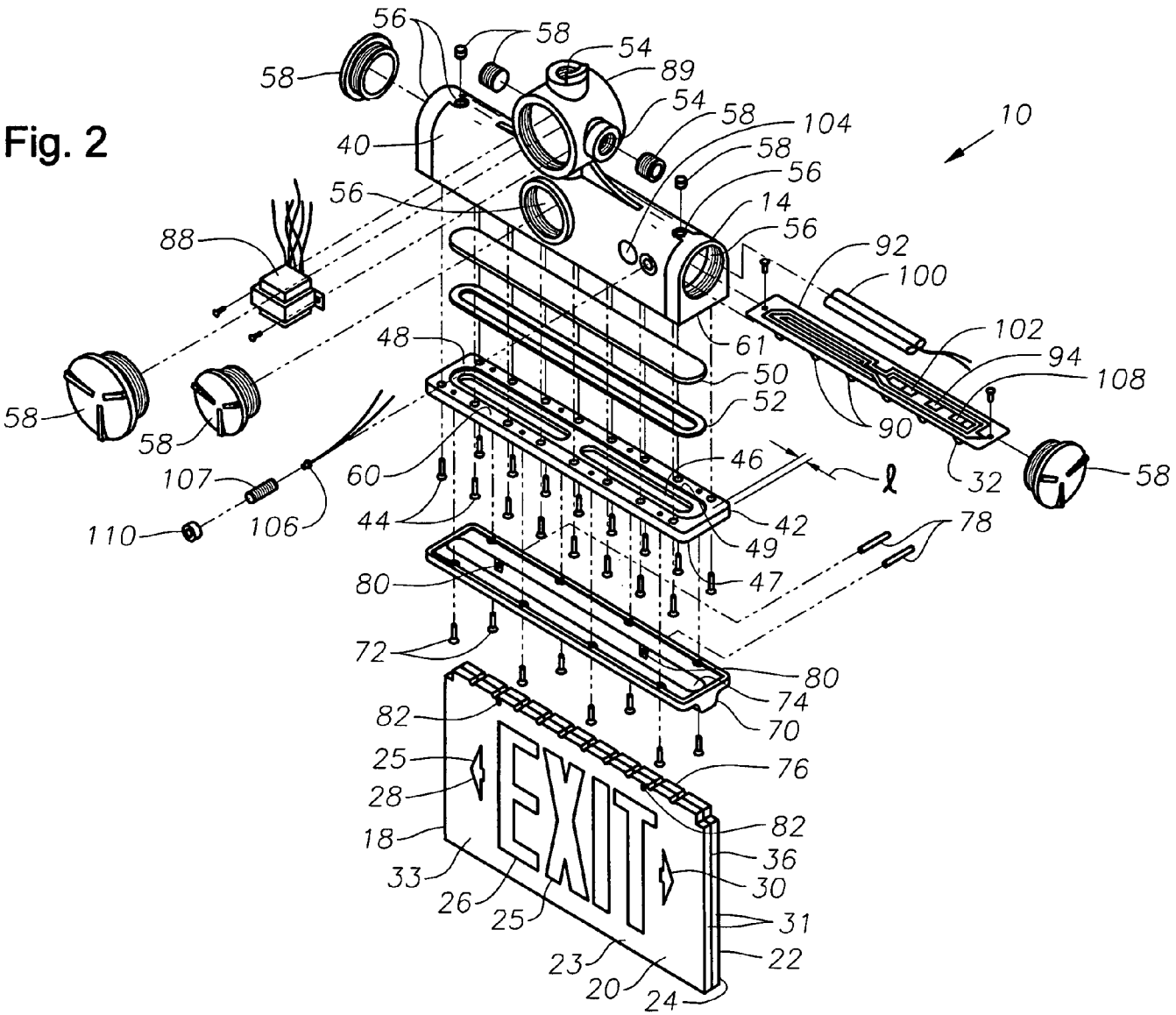
FIG. 2 is an explosion diagram of the explosion-proof exit sign of FIG. 1.

Referring to FIGS. 1 and 2, a preferred embodiment of the invention is an exit sign 10 suitable for use in locations deemed hazardous due to the presence or potential presence of flammable vapors or gases or combustible dusts. Exit sign 10 is preferably designed and arranged to be certified for use in NEC Class I Division 1 and 2, Groups C and D, Class I Zone 1 Group IIB, and Class II Division 1 Groups E, F and G. More preferably, exit sign 10 may also be certified for use in Class I Zones 0, 1 and 2 Groups IIA, IIB plus hydrogen, and IIC areas. More preferably still, exit sign 10 is also certified for use in Class III areas. Exit sign 10 preferably complies with UL Standard 844. UL Standards 844, 1604 and 2279 are incorporated herein by reference. The exit sign 10 preferably includes an explosion-proof housing 14 and a sign panel 18 having generally planar first and second sides, 20, 22, respectively (FIG. 2).

If the exit sign 10 is arranged for parallel mounting to a wall, the sign panel 18 typically has only one face 23 which is disposed on the first planar side 20 of sign panel 18 which faces away from the wall so as to be in plain view. Face 23 preferably includes one or more emergency indicia 25, such as a word 26, e.g., "EXIT," "SORTIE," or "SALIDA." Preferably, word 26 uses six inch letters with a ¾ inch stroke and meets appropriate safety standards, e.g., NFPA Life Safety Code No. 101. Indicia 25 may also include an optional left arrowhead 28, right arrowhead 30, or both left and right arrowheads to indicate one or more directions. Alternatively, if the exit sign 10 is arranged for transverse mounting to a wall or for pendant mounting from a ceiling, both the first side 20 and the second side 22 of sign panel 18 preferably have faces 23, 24 with appropriate indicia 25. For example, if the first face 23 includes a right arrowhead 30, the second face 24 might include a left arrowhead 28.

The sign panel 18 preferably includes one or more transparent or translucent sheets 31 which are edge lit from a light source 32 (FIG. 2) contained in housing 14. Preferred sheet material includes acrylic, Plexiglas™ or other suitable thermoplastics, for example. Indicia are preferably formed on a sheet 31 by relief, etching, opaque masks, or similar method. The light source 32 may be colored to further contrast the indicia 25 from the background 33 of faces 23, 24. Additionally or alternatively, the relief, etching or opaque masks may be colored for a similar effect, with the advantage of indicia contrast even when the exit sign 10 is not illuminated. Common sign panel 18 schemes include red indicia 25 against a white background 33 and green indicia 25 against a clear background 33, but other schemes, including reverse contrast, may be used. For double-faced exit signs, sign panel 18 preferably includes an opaque or mirrored separator 36 (FIG. 2) sandwiched between two clear edge-lit thermoplastic sheets 31 to prevent a user from viewing the indicia 25 of the obverse face through the sign panel 18. The mirrored separator 36 also enhances the aesthetic appearance of the exit sign 10.

Referring to FIG. 2, the explosion-proof housing 14 preferably includes a top shell 40 and a bottom plate 42, but other arrangements may be employed. Bottom plate 42 mounts to top shell 40 using a number of screws 44. Bottom shell 42 preferably has holes or slots to form a window 46 to allow light from light source 32, located within top shell 40, to pass through the plate. The upper surface 48 of bottom plate 42 preferably includes a recess 49 for receiving a clear glass or plastic window pane 50 and a gasket 52. Top shell preferably includes one or more standard ¾ inch American National Standard Taper Pipe Thread (NPT) hubs 54 for coupling to electrical conduit and one or more threaded access ports 56 with complementary plugs 58.

Thus, top shell 40, window pane 50, gasket 52, bottom plate 42, plugs 58, and screws 44 assemble to form housing 14, an enclosure which must be capable of withstanding an explosion of a specified gas or vapor within the enclosure. The ability of housing 14 to withstand an internal explosion without rupturing or being permanently deformed depends upon the strength of the various enclosure materials and the overall strength and holding power of the securement means, i.e., the screws 44. The strength of the housing 14 is affected in part by the design of top shell 40 and bottom plate 42 (shapes, casting/molding design, alloy choices, thicknesses, et cetera). Top shell 40 and bottom plate 42 are preferably manufactured from copper-free aluminum alloy, but other suitable materials not containing zinc or magnesium may be used. If window pane 50 is plastic, the type of plastic used is preferably resistant to chemical atmospheres. Likewise, gasket 52 is preferably chemically resistant. The number and type of screws 44 are selected to withstand the expected explosion forces. Preferably, the housing 14 is hydrostatically tested to a pressure of at least four times the expected explosion pressure.

Additionally, housing 14 must be capable of preventing the ignition of gas or vapor surrounding the enclosure due to sparks, flashes or an explosion of the gas or vapor within the enclosure. The ability of an enclosure to prevent ignition of a specified gas or vapor surrounding the enclosure is dependent on the ability of any potential flame path from the interior to the exterior of the enclosure to prevent the escape of any flames, sparks or hot particles capable of ignition and to sufficiently cool the vented material and gases. The upper surface 48 of bottom plate 42 has a mating surface 60 which surrounds recess 49. Top shell 40 preferably has a complementary mating surface 61 which corresponds to the bottom plate mating surface 60. Mating surfaces 60 and 61 are carefully machined to generally form a tight metal-to-metal interface without the use of a gasket or other sealing material. Mating surfaces 60 and 61 have a minimum seal length l from every interior point along the perimeter of the mating surface to the nearest exterior point. The minimum seal length l provides ample heat sink surface along any flame path between the mating surfaces 60, 61 to sufficiently cool gases escaping through that interface to prevent ignition of gases or vapors surrounding the housing 14. The minimum seal length l is dependent on the intrinsic ability of the mating surfaces 60, 61 to act as a heat sink (e.g., thermal conductivity and the immediate thickness the heat sink surfaces) and the distance between the mating surfaces 60, 61, i.e., the flatness and surface finish of metal-to-metal sealing surfaces. The greater the spacing existing between bottom plate mating surface 60 and top shell mating surface 61, then the greater the minimum seal length l must be in order to prevent ignition propagation. The metal-to-metal interface between bottom plate mating surface 60 and top shell mating surface 61 preferably allows sufficiently rapid escape of gases from an internal explosion to prevent leakage past or rupture of gasket 52. Additionally, screws 44 and plugs 58 must have sufficient thread engagement for the land-groove clearances to act sufficiently as a heat sink to cool gases escaping housing 14 via the threads.

Further, housing 14 must be capable of operating at an external temperature that will not ignite the surrounding gas or vapor. The ability of an enclosure to prevent ignition of a specified gas or vapor surrounding the enclosure is dependent on how the heat-producing components within the enclosure affect the temperature on the external surfaces of the enclosure. The greater the external housing surface area is, the greater the heat-dissipating capacity of the housing will be and the cooler the external surface will be for a given internal heat source. These effects are preferably measured and represented as a temperature code, which must be less than the lowest auto-ignition temperature of the surrounding hazardous atmosphere. The exit light 10 preferably has a temperature rating meeting or exceeding T3C for ambient temperatures of 25 and 40 degrees Celsius.

The sign panel 18 is preferably attached to housing 14 by a molded or cast shroud 70. Shroud 70 preferably screws to the bottom surface 47 of bottom plate 42 using screws 72. Shroud 70 has an aperture 74 which receives the top edge 76 of sign panel 18 for abutment to the bottom surface 47 of bottom plate 42 in alignment with window 46. Thus, light from light source 32 in housing 14 shines through window pane 50 and window 46 into the top edge 76 of sign panel 18 fitted within shroud aperture 74 to illuminate faces 23, 24 (and the indicia 25 thereon). Sign panel 18 is held in place in aperture 74 by pins 78 which are transversely positioned through slots 80 in shroud 70 and holes 82 in sign plate 18, which are in alignment.

Light source 32 preferably utilizes a number of long life light emitting diodes (LEDs) 90. The LEDs 90 are preferably mounted on a printed circuit board (PCB) 92 to align with window 46 and the top edge 76 of sign panel 18. A step-down transformer 88, having an input coil for connecting to line voltage and a secondary coil which powers PCB 92, is preferably included in an upper portion 89 of top shell 40. PCB 92 preferably contains low voltage circuitry 94, e.g., a rectifier, voltage regulator, protective circuit elements, et cetera, for providing normal power to the LEDs 90. The LEDs 90 may be any available color or a combination of colors, but red or green are preferred. The number and type of LEDs 90 are preferably chosen so that exit light 10 conforms with the Occupational Safety and Health Administration (OSHA) standards for exit sign illumination. The LED light source 32 consumes approximately 2-4 watts, compared to 50-120 watt consumption for a dual incandescent bulb light source. LEDs also have a significantly longer expected lifespan than incandescent bulbs, reducing the need to open housing 14 for maintenance.

Although not required, exit sign 10 preferably includes a battery 100 for powering light source 32 when externally supplied power to exit sign 130 is absent. Preferably, battery 100 is a sealed maintenance-free rechargeable battery, such as nickel-cadmium, lithium ion, or lead-acid types. A charging circuit 102 is preferably provided (preferably included on PCB 92, but it may be located elsewhere) to intelligently maintain battery 100 at an optimal charge and to automatically recharge battery 100 after a discharge. A low voltage disconnect feature in charging circuit 102 preferably prevents excessive battery discharge that can permanently damage the battery 100. Battery 100 preferably has a 90 minute or greater capacity to power light source 32.

Preferably, a manually operated test switch 104 is included in exit sign 10 to allow a user to check battery 100 operation. Preferably, switch 104 is magnetically actuated through housing 14 in order to maintain the explosion-proof integrity of housing 14, but other explosion-proof switches may be used. Test switch 104 ideally executes a diagnostic testing sequence. A health indicator 106 displays exit sign 10 status, e.g., normal operating mode, diagnostic testing mode, emergency power operation mode, high-rate battery charging mode, battery failure, light source failure, and circuit failure. For example, health indicator 106 may be a multicolor LED. A clear cylindrical threaded lens 107 is preferably used to maintain housing 14 explosion-proof integrity while allowing health indicator 106 to be readily viewed, and a bezel 110 may be used to provide a clean finished appearance. Diagnostic testing may be implemented using a microcomputer 108. Microcomputer 108 is preferably included on PCB 92, but it may be located elsewhere. Additionally, part or all of the charging circuit 102 may be integrated with microcomputer 108. Microcomputer 108 may also perform self-diagnostic testing of exit sign 10 in addition to manually initiated testing. For example, a self diagnostic testing procedure may be run for 5 minutes every 30 days and for 30 minutes ever 6 months.

Because the arts of PCB design and manufacture, power and battery charging circuit design and manufacture, microcomputer design and programming, casting, molding, metal and plastic design, testing and fabrication, and assembly are well known in the art, they are not discussed further herein.

The Abstract of the disclosure is written solely for providing the United States Patent and Trademark Office and the public at large with a means by which to determine quickly from a cursory inspection the nature and gist of the technical disclosure, and it represents solely a preferred embodiment and is not indicative of the nature of the invention as a whole.

While the preferred embodiment of the invention has been illustrated in detail, the invention is not limited to the embodiment shown. For example, although the preferred embodiment described is an explosion-proof LED edge-lit exit sign, other non-incandescent light sources and illumination techniques, such as the use of a sign box or fiber optics, are within the scope of the invention. Additionally, the scope of the invention includes other illuminated signs and placards for use in hazardous areas and is not limited to exit signs or other emergency fixtures. For example, the illuminated sign according to the invention may be used to indicate the location of an eyewash station or an isle number. It is apparent that modifications and adaptations of the above embodiment may occur to those skilled in the art. Such modifications and adaptations are in the spirit and scope of the invention as set forth herein:

What is claimed is:

1. A method of aiding emergency egress from an area with a hazardous or potentially hazardous atmosphere comprising the steps of, providing a sign panel (18) having at least one face (23, 24) characterized by an indicium (25) directing a viewer to a location for egress, illuminating said sign panel by a plurality of light emitting diodes (90), housing said plurality of light emitting diodes in an enclosure (14), allowing a first gas, vapor or dust disposed within said enclosure to ignite or explode without deforming or rupturing said enclosure, and cooling exhaust exiting said enclosure from said ignition or explosion within said enclosure to a temperature below a lowest auto-ignition temperature of a second gas, vapor, or dust surrounding said enclosure.

2. The method of claim 1 further comprising the step of, illuminating said sign panel (18) by shining light from said plurality of light emitting diodes (90) into an edge (76) of said sign panel, wherein said sign panel is generally transparent or translucent.

3. A method of aiding emergency egress from an area with a hazardous or potentially hazardous atmosphere comprising the steps of, providing a sign panel (18) having at least one face (23, 24) characterized by an indicium (25) directing a viewer to a location for egress, illuminating said sign panel by a plurality of light emitting diodes (90), powering said plurality of light emitting diodes with a battery (100), recharging said battery, housing said battery and said plurality of light emitting diodes in an enclosure (14), allowing a first gas, vapor or dust disposed within said enclosure to ignite or explode without deforming or rupturing said enclosure, and cooling exhaust exiting said enclosure from said ignition or explosion within said enclosure to a temperature below a lowest auto-ignition temperature of a second gas, vapor, or dust surrounding said enclosure.

4. The method of claim 3 further comprising the step of, illuminating said sign panel (18) by shining light from said plurality of light emitting diodes (90) into an edge (76) of said sign panel, wherein said sign panel is generally transparent or translucent.

5. The method of claim 3 further comprising the step of, diagnosing and displaying a status of said battery (100) and said plurality of light emitting diodes (90).

6. The method of claim 5 further comprising the step of, automatically diagnosing and displaying a status of said battery (100) and said plurality of light emitting diodes (90).

7. An exit sign (10) comprising, an explosion-proof housing (14), said housing comprising a first portion (40) and a second portion (42) attached thereto and defining an interface between said first portion and said second portion, said interface defining a vent path for gases within said housing to exit said housing, said first portion and said second portion defining a heat sink for cooling said gases exiting said housing through said vent path, a window (46) disposed in said second portion, a generally planar sign panel (18) having a first edge (76) which is coupled to said second portion at said window, an indicium (25) disposed on said sign panel, a plurality of light emitting diodes (90) disposed within said housing and directed to shine light through said window into said first edge of said sign panel, and a rechargeable battery (100) disposed within said housing and operatively coupled to said plurality of light emitting diodes for powering thereof.

8. The exit sign (10) of claim 7 further comprising, circuitry (102) for diagnosing said battery (100) and determining a status thereof, said circuitry disposed in said housing (14) and operatively coupled to said battery, a health indicator (106) disposed in an opening in said housing and operatively coupled to said circuitry and designed and arranged to indicate said status of said battery, said opening in said housing disposed such that said health indicator is viewable from a point exterior to said housing, and a lens (107) sealingly disposed in said opening.

* * * * *